United States Patent [19]

Kawajiri

[11] Patent Number: 4,673,005

[45] Date of Patent: Jun. 16, 1987

[54] AIR JET LOOM

[75] Inventor: Mitugu Kawajiri, Iruma, Japan

[73] Assignee: Nissan Motor Co., Ltd., Yokohama, Japan

[21] Appl. No.: 811,734

[22] Filed: Dec. 20, 1985

[30] Foreign Application Priority Data

Dec. 25, 1984 [JP] Japan ..... 59-271861

[51] Int. Cl.[4] ..... D03D 47/30

[52] U.S. Cl. ..... 139/435; 139/452

[58] Field of Search ..... 139/11 E, 435, 450, 139/452; 226/97

[56] References Cited

U.S. PATENT DOCUMENTS

| | | | |
|---|---|---|---|
| 4,102,361 | 7/1978 | Tanaka et al. . | |
| 4,332,280 | 6/1982 | Manders | 139/435 |
| 4,410,016 | 10/1983 | Manders . | |
| 4,450,876 | 5/1984 | Mullekom | 139/435 |
| 4,550,753 | 11/1985 | Tsuji | 139/435 |

FOREIGN PATENT DOCUMENTS

| | | |
|---|---|---|
| 2701038 | 4/1980 | Fed. Rep. of Germany . |
| 3224093 | 1/1983 | Fed. Rep. of Germany . |
| 626668 | 11/1981 | Switzerland . |
| 1596964 | 4/1978 | United Kingdom . |

*Primary Examiner*—Henry S. Jaudon

*Attorney, Agent, or Firm*—Schwartz, Jeffery, Schwaab, Mack, Blumenthal & Evans

[57] ABSTRACT

An air jet loom is equipped with a weft inserting nozzle through which a weft yarn is picked under a traction force of an air jet ejected therefrom. The loom is provided with a weft picking system which is so controlled as to accomplish a weft picking under the traction force at a first level during normal loom operation while increasing the traction force to a second level not lower than the first level for a predetermined time at starting of the loom, thereby preventing shortpick at the loom starting.

27 Claims, 18 Drawing Figures

AIR JET LOOM

BACKGROUND OF THE INVENTION

1. Field of the Invention

This invention relates generally to an improvement in an air jet loom, and more particularly to a weft picking system of the air jet loom arranged to improve weft picking performance when the loom is started.

2. Description of the Prior Art

In connection with air jet looms of the type wherein a weft yarn is picked under the influence of an air jet ejected from a weft inserting nozzle, when mispick or warp yarn cutting occurs, the loom is stopped to remove the cause of the mispick or warp yarn cutting thereby restoring the loom into a normal condition. Thereafter the loom is re-started upon operating a loom starting switch.

However, such re-start is made upon supplying the weft inserting nozzle with pressurized air whose pressure is the same as before the loom stopping. With such pressure of a relatively low level, a considerable time is required to fill an air supply passage leading to the weft inserting nozzle, thereby delaying application of a traction force due to the air pressure to the weft yarn. As a result, a shortage of traction force occurs, thus causing mispick and particularly shortpick.

SUMMARY OF THE INVENTION

An air jet loom according to the present invention consists of a weft inserting nozzle through which a weft yarn is picked under a traction force of an air jet ejected therefrom. A weft picking control system is provided to accomplish a weft picking under the traction force at a first level during normal loom operation except at least when the loom is started. Additionally, a traction force increasing device is provided to increase the traction force to a second level not lower than the first level for a predetermined time at starting of the loom. Accordingly, a shortage of traction force to the weft yarn can be compensated, thus effectively preventing mispick and particularly short pick when the loom is started.

BRIEF DESCRIPTION OF THE DRAWINGS

The features and advantages of the air jet loom according to the present invention will be more clearly appreciated from the following description taken in conjunction with the accompanying drawings in which like reference numerals designate corresponding elements, and in which.

DETAILED DESCRIPTION OF THE INVENTION

Figure 1:
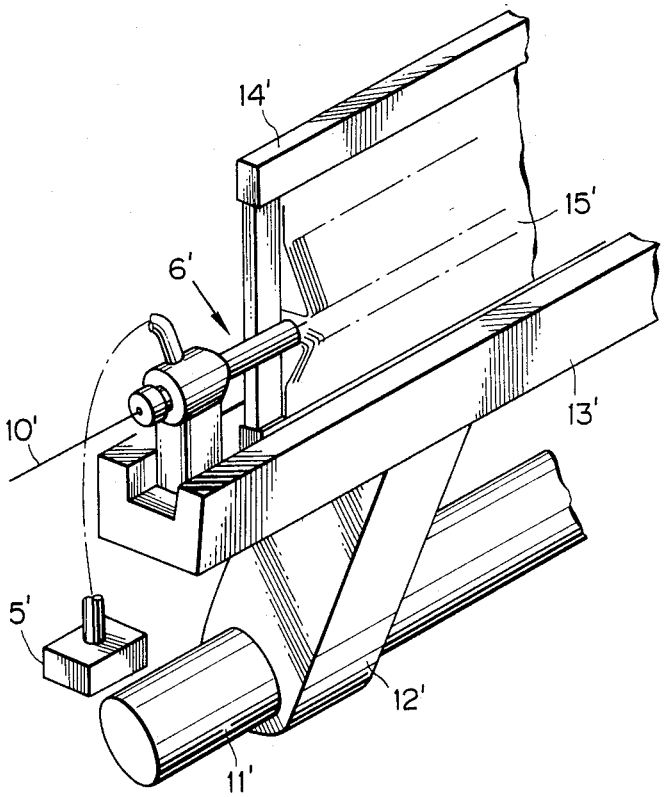
FIG. 1 (PRIOR ART)
FIG. 1 is a perspective view of an essential part of a weft picking system of a conventional air jet loom.
Figure 2:
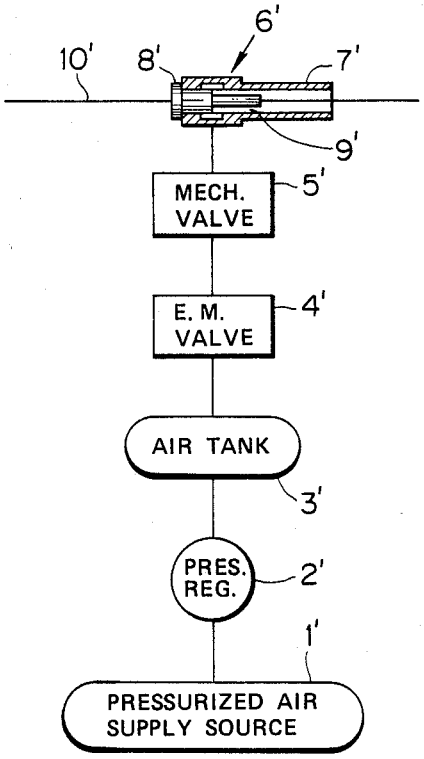
FIG.2 (PRIOR ART)
FIG. 2 is a block diagram of the weft picking system of the conventional air jet loom of FIG. 1.

To facilitate understanding the present invention, a brief reference will be made to a weft picking system of a conventional air jet loom, depicted in FIGS. 1 and 2. Referring to FIGS. 1 and 2, the conventional weft picking system consists of a main nozzle or weft insertin9 nozzle 6' which is supplied with pressurized air from a pressurized air supply source 1' through a pressure regulator 2', an air tank for pressure stabilizing purpose, an electromagnetic valve 4', and a mechanical valve 5'. The main nozzle 6' is fixedly installed on a sleigh 13' which is fixedly connected through a sley sword 12' to a sley sword shaft 11'. The electromagnetic valve 4' is adapted to be opened upon closing a preparation switch (not shown) of the loom and closed upon generation of a stopping signal of the loom. The mechanical valve 5' is located in the vicinity of the sley sword shaft 11' and adapted to be opened during a weft picking time period by means of a cam (not shown) rotatable in timed relation to a main shaft (not shown) of the loom through which shaft power for driving the loom is supplied. The main nozzle 6' consists of a main body 7' into which a yarn introduction pipe 8' is fitted, forming therebetween an air ejection opening 9' in the form of an orifice.

With this conventional arrangement, during a normal loom operation, pressurized air is pressure regulated by the pressure regulator 2' and is stored in at least an amount required for one pick in the air tank 3'. When the mechanical valve 5' is opened during the weft picking time period, the pressurized air in the air tank 3' is supplied to the main nozzle 6', so that the pressurized air is o 30 ejected from the air ejection opening 9' thereby forming an air stream. This air stream pulls a weft yarn 10' passed through the weft introduction pipe 8' in such a manner that the weft yarn 10' is wrapped in the air stream, so that the weft yarn 10' is projected toward a weft picking passage 15' formed for example in a reed 14' which passage is located within a warp shed (not shown). The thus projected weft yarn 10' is carried by the air stream from the main nozzle 6' or by air ejected from auxiliary nozzles (not shown) arranged along the weft picking passage 15', thereby achieving a weft picking. However, the following drawbacks have been encountered in such a conventional weft picking system: At a re-start of the loom after a loom operation has stopped, a weft picking is made with the same air pressure as before the loom operation stopped, thereby causing mispick, particularly so-called shortpick, i.e., the tip end section of the weft yarn does not reach a warp yarn line located on the most anti-weft picking side.

It is believed that this drawback is caused as follows. During a loom operation, pressurized air remaining in an air supply passage between the mechanical valve 5' and the main nozzle 6' is prevented from ejection even after closing of the mechanical valve 5' under the orifice action of the air ejection opening 9', so that the pressurized air remains therein until the next weft picking or the next opening of the mechanical valve 5'. Consequently, the remaining pressurized air will be added to fresh pressurized air to be supplied by the next opening of the mechanical valve 5', thus initiating an air ejection. As a result, an air stream having a predetermined flow rate is quickly formed, so that the traction force to the weft yarn 10' is enlarged thereby accomplishing an effective weft picking.

However, at a re-start of the loom, an air ejection for weft picking is made after the air supply passage downstream of the mechanical valve 5' is filled with pressurized air to attain the same state as during normal loom operation, so that applying the traction force to the weft yarn is delayed by a time period required for filling the pressurized air to the air supply passage to reach the same condition as during normal loom operation. As a result, there arises a shortage of traction force applied to the weft yarn, thereby causing the above-mentioned short pick.

In order to overcome the above drawbacks of the weft picking system of the conventional air jet loom, it might be proposed to set the pressure of air at a higher level in order to obtain a sufficient traction force even at a re-start of the loom. However, this will provide too high traction force during normal loom operation and will be accompanied by the following disadvantages. For instance, yarn cutting will arise when a weak weft yarn is used. Additionally, a loom operating on a high air pressure is undesirable from the point of view of energy saving while causing a weft knot and the like thereby to lower the quality of a woven fabric particularly when the air pressure is extremely high.

Figure 3:
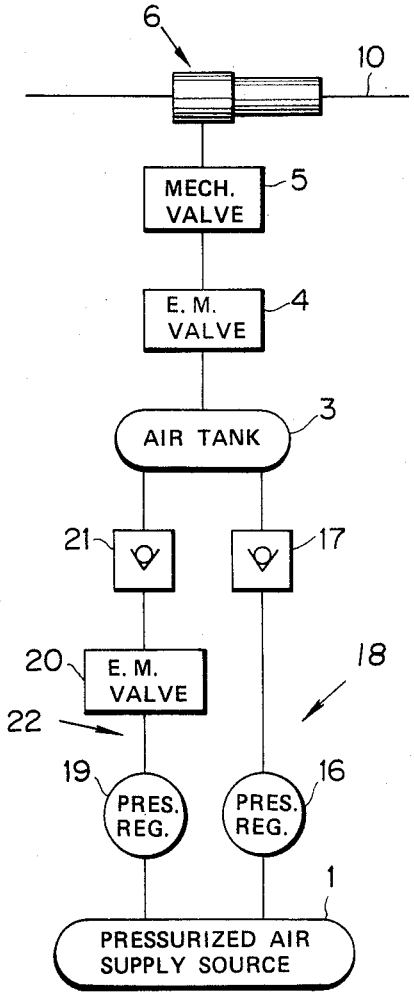
FIG. 3 is a block diagram of a weft picking system of a first embodiment of an air jet loom in accordance with the present invention.
Figure 4:
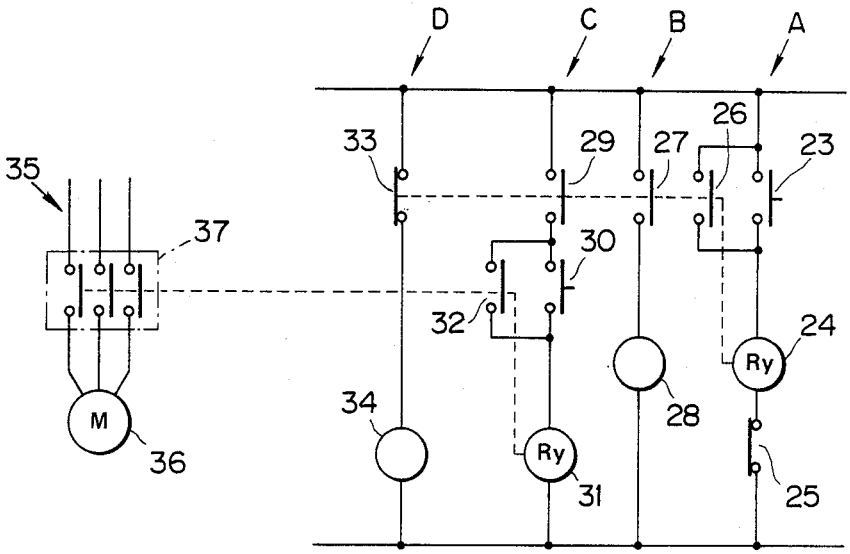
FIG. 4 is a circuit diagram of a control system for the loom of FIG. 3.

In view of the above description of the conventional weft picking system, reference is now made to FIGS. 3 to 17 illustrating the present invention made for the purpose of overcoming drawbacks encountered in the conventional air jet loom. Referring to FIGS. 3 and 4, there is shown a first embodiment of an air jet loom in accordance with the present invention. The loom is provided with a weft picking system consisting of a main nozzle or weft inserting nozzle 6 which is adapted to be supplied with pressurized air from a pressurized air supply source 1 through first or second air supply lines 18, 22, an air tank 3 for pressure stabilizing purpose, an electromagnetic valve 4, and a mechanical valve 5. The main nozzle 6 of this case is constructed and installed in the same manner as in the conventional loom shown in FIGS. 1 and 2. The mechanical valve 5 is in fluid communication with the main nozzle 6 and adapted to be opened during a weft picking time period by means of a cam (not shown) rotatable in timed relation to a main shaft (not shown) of the loom through which shaft power for driving the loom is supplied. The electromagnetic valve 4 is in fluid communication with the mechanical valve 5.

The air tank 3 is in fluid communication with the electromagnetic valve 4 and further fluidly connectable with the pressurized air supply source 1 through the first or second air supply lines 18, 22. The first air supply line 18 is operable during a normal loom operation and includes a pressure regulator 16 which is fluidly connectable through a check valve 17 with the air tank 3. The pressure regulator 16 is further fluidly connected with the pressurized air supply source 1 and adapted to regulate the pressure of air from the pressurized air supply source 1 at the lower level within a range where mispick hardly arises. The second air supply line 22 is provided in parallel relation with the first air supply line 18 and operable during a re-start of the loom. The second air supply line 22 includes a pressure regulator 19 in fluid communication with the pressurized air supply source 1 and further in fluid communication with an electromagnetic valve 20 which is in turn fluidly communicable through a check valve 21 with the air tank 3. The pressure regulator 19 is adapted to regulate the pressure of air from the pressurized air supply source 1 at a level within a range where none of mispick and yarn cutting arise during a re-start of the loom, the level being higher than the above-mentioned pressure level regulated by the pressure regulator 16 of the first air supply line 18. The electromagnetic valve 20 is adapted to open and close as will be discussed hereinafter with reference to FIG. 4.

FIG. 4 shows a control system of the loom which system includes a preparation circuit A for a loom operation, a control circuit B for the electromagnetic valve 4, a starting circuit C for a loom operation, and a control circuit D for the electromagnetic valve 20. The preparation circuit A includes a normally opened push-button preparation switch 23, a relay 24, and a normally closed stopping switch 25 which are connected in series with each other. Additionally, a normally opened contact 26 for the relay 24 is connected in parallel with the preparation switch 23. The control circuit B includes a normally opened contact 27 connected in parallel with a coil 28 of the electromagnetic valve 4. The starting circuit C includes a normally opened contact 29 of the relay 24, and a normally opened push-button starting switch 30 which are connected in series with each other. Additionally, a normally closed contact 32 of the relay 31 is connected in parallel with the starting switch 30. The control circuit D includes a normally closed contact 33 of the relay 24 which contact is connected in series with a coil 34 of the electromagnetic valve 20. A motor operation circuit 35 for a loom driving motor 36 is provided with a contact 37 connected with the relay 31. The contact 37 is closed upon operation of the relay 31.

The manner of operation of the weft picking system shown in FIGS. 3 and 4 will be discussed hereinafter.

During a continuous normal operation of the loom, the relay 24 is being operated to close the contact 26, and therefore the preparation circuit A enters its self-hold mode. The coil 28 of the control circuit B is energized upon closing of the contact 27, thereby opening the electromagnetic valve 4. The relay 31 is operated upon closing of the contact 29, thereby closing the contact 32. As a result, the starting circuit C enters its self-hold mold. The contact 37 is closed upon operation of the relay 31, thereby operating the loom driving motor 36 to drive the loom. Since the contact 33 is opened, the coil 34 of the control circuit D is not energized, so that the electromagnetic valve 20 is closed. Accordingly, during the continuous normal loom operation, the main nozzle 6 is supplied with pressurized air whose pressure is regulated by the pressure regulator 16 of the first air supply line 18.

When the stopping switch 25 is opened upon any stopping of the loom, the operation of the relay 24 is stopped thereby causing the contacts 26, 27, 28 to be opened so that the contact 33 is closed. The self-hold of the preparation circuit A is released upon opening of the contact 26, and the electromagnetic valve 4 is closed since the coil 28 of the control circuit B is de-energized. The relay 31 is rendered inoperative upon opening of the contact 29, thereby causing the contact 32 and the contactor 37 to be opened. Accordingly, the self-hold of the starting circuit C is released while stopping the loom driving motor 36. Simultaneously, a braking device (not shown) is operated to stop the operation of the loom. The coil 34 of the control circuit D is energized upon closing of the contact 33, thereby closing the electromagnetic valve 20. As a result, the air tank 3 is filled with pressurized air at a high pressure which is regulated by the pressure regulator 19 of the second air supply line 22. This high pressure air cannot leak into the first air supply line 18 under the action of a check valve 17 disposed in the first air supply line 18.

When the preparation switch 23 is closed to re-start the loom, the contacts 26, 27, 28 are closed upon operation of the relay 24, thereby causing the contact 33 to be opened. As a result, the preparation circuit A enters its self-hold mold, while the coil 28 of the control circuit B is energized thereby to cause the electromagnetic valve 4 to be opened. Additionally, the coil 34 of the control circuit D is de-energized upon opening of the contact 33, thereby causing the electromagnetic valve 20 to be closed. Subsequently, when the starting switch 30 is closed, the contact 32 and the contactor 37 are closed upon operation of the relay 31. As a result, the starting circuit C enters its self-hold mold, and the loom driving motor 36 initiates driving of the loom. Accordingly, when the mechanical valve 5 is opened at the time of weft picking, the weft yarn 10 is picked under the influence of air jet ejection from the main nozzle 6. The pressure of the air to be supplied to the main nozzle 6 at the time the loom is started is regulated by the regulator 19 and therefore higher than that of the air to be supplied to the main nozzle 6 during the normal loom operation after the loom has started. Thus, the traction force to the weft yarn 10 is increased by an amount corresponding to the raised air pressure, to obtain a weft yarn traction force equal to or higher than during the normal loom operation even in the situation where air ejection time of the main nozzle 6 is shortened by an amount corresponding to a time required to fill the pressurized air into the air supply passage between the mechanical valve 5 and the main nozzle 6. Thereafter, the pressure within the air tank 3 is lowered upon consumption of the pressurized air. When the pressure within the air tank 3 is lowered below the pressure regulated by the regulator valve 16, the presurized air, whose pressure is regulated by the pressure regulator 16, is supplied through the check valve 17 to the air tank 3 to be used for a weft picking.

Figure 6:
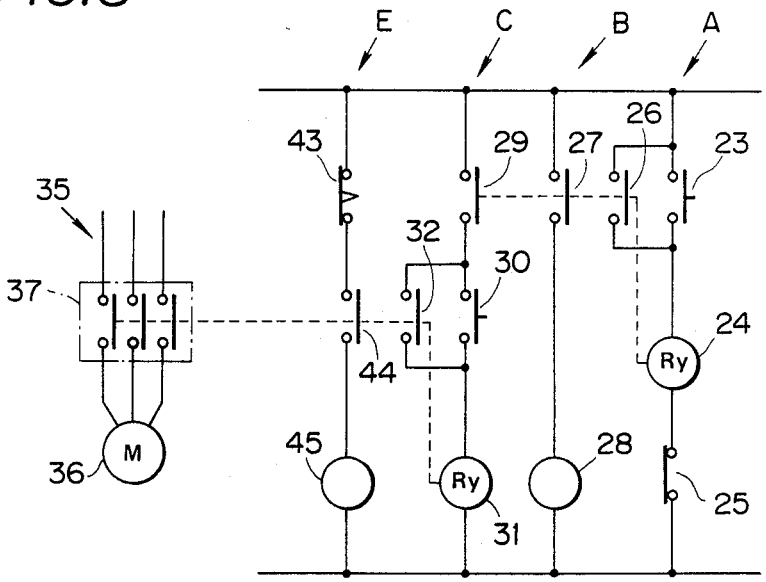
FIG. 6 is a circuit diagram of a control system for the loom of FIG. 5.
Figure 5:
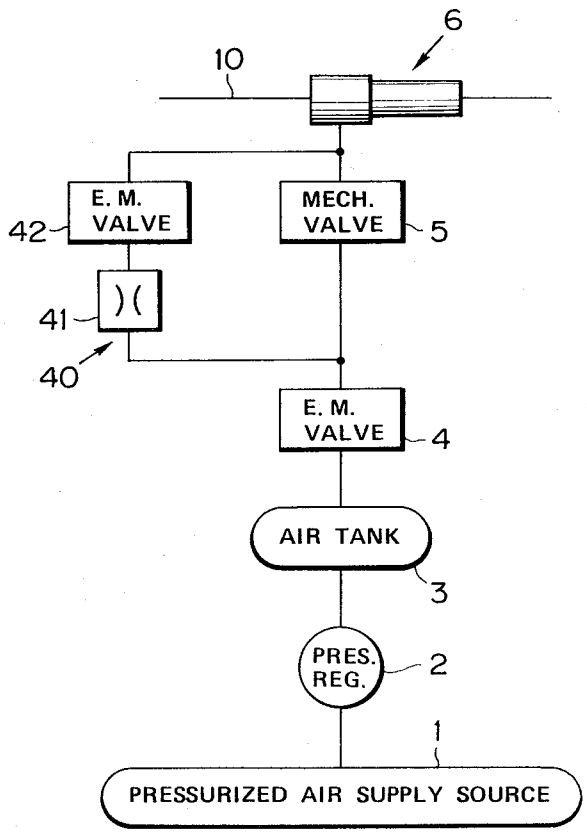
FIG. 5 is a block diagram of a weft picking system of a second embodiment of an air jet loom in accordance with the present invention.

FIGS. 5 and 6 illustrate a second embodiment of the air jet loom according to the present invention, whose weft picking system is similar to that of the first embodiment with the exception that a pressure regulator 2 is used in plae of the first and second air supply lines 18, 20, and an air supply line 40 (for loom operation starting) including a restrictor 40 and an electromagnetic valve 42 is disposed in parallel with the mechanical valve 5 as shown in FIG. 5. More specifically, the pressure regulator 2 is fluidly connected to the pressurized air supply source 1 and to the air tank 3 in such a manner that air whose pressure is regulated by the pressure regulator 2 is supplied to the air tank 3. The pressure regulator 2 is adapted to regulate the pressure of the air from the pressurized air supply source 1 at the lowest level within a range where mispick hardly arises. The restrictor 41 is fluidly connected with an air supply passage (no numeral) between the electromagnetic valve 4 and the mechanical valve 5, and further fluidly connected with the electromagnetic valve 42. The electromagnetic valve 42 is fluidly connected with an air supply passage (no numeral) between the mechanical valve 5 and the main nozzle 6.

A control system of the loom of the second embodiment is shown in FIG. 6, which is similar to the control system of FIG. 4 related to the first embodiment loom except for a control circuit E for the electromagnetic valve 42. The control circuit E includes a timer contact 43 which is adapted to be opened upon the lapse of a predetermined time after electric current is supplied thereto. A contact 43 is connected in series with the timer contact 43 and adapted to be closed upon operation of the relay 31. Additionally, a coil 45 of the electromagnetic valve 42 is connected in series with the contact 44. The closing time period of the timer contact 43 is set at such a value that the air supply passage between the mechanical valve 5 and the main nozzle 6 is filled with pressurized air whose pressure is the same as immediately before the initiation of weft picking during normal loom operation by the time the first weft picking of the loom is carried out.

In operation of the weft picking system of FIG. 5 with the control system of FIG. 6, when the preparation switch 23 is first closed, the relay 24 is operated thereby causing the contacts 26, 27, 29 to be closed. The preparation circuit A enters its self-hold mode upon closing of the contact 26. The coil 28 in the control circuit B is closed upon closing of the contact 27, thereby causing the electromagnetic valve 4 to be closed. As a result, the pressurized air reaches the inlet port (not shown) of the mechanical valve 5 and of the electromagnetic valve 42. Subsequently, when the starting switch 30 is closed, the relay 31 is operated thereby causing the contacts 32, 44 and the contactor 37 to be closed. The starting circuit C enters its self-hold mode upon closing of the contact 32. The coil 45 in the control circuit E is energized upon closing of the contact 44, thereby causing the electromagnetic valve 42 to be closed. Simultaneously, the timer contact 43 initiates its closing operation. Additionally, the loom driving motor 36 starts to operate upon closing of the contactor 37. Upon opening of the electromagnetic valve 42, the pressurized air choked by the restrictor 41 is supplied to the air supply line between the mechanical valve 5 and the air ejection opening of the main nozzle 6, so that the air supply line is filled with the pressurized air whose pressure is the same as that during the normal loom operation by the time immediately before opening of the mechanical valve 5. Upon opening of the timer contact 43 after the predetermined time lapses, the coil 45 is de-energized thereby causing the electromagnetic valve to be closed. Immediately after this, the mechanical valve 5 is opened to feed the pressurized air to the nozzle 6, thereby accomplishing the weft picking of the weft yarn 10. Thus, with this embodiment, the pressurized air is supplied to the air supply passage between the mechanical valve 5 and the main nozzle 6 via the air supply line 40, so that the condition is the same as during the normal loom operation in the air supply passage leading to the main nozzle 6, thus achieving a first weft picking at loom starting without causing mispick.

Figure 7:
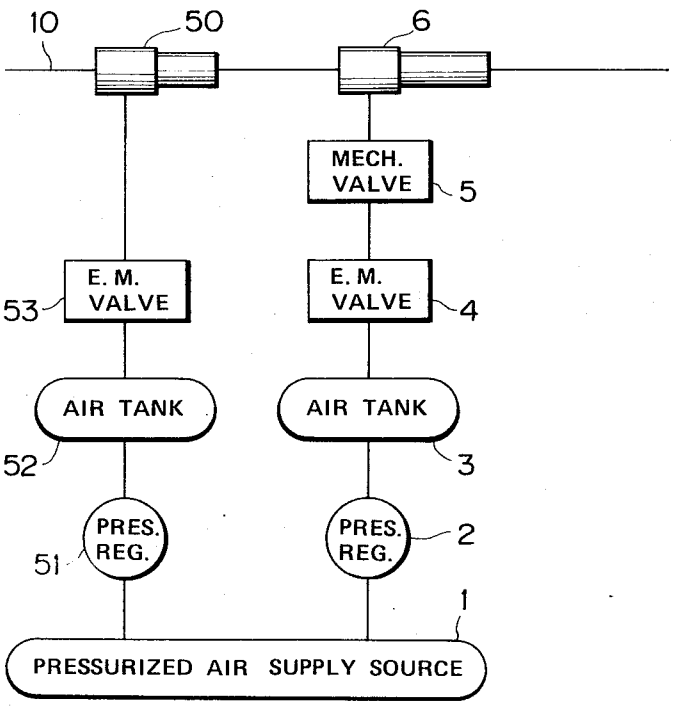
FIG. 7 is a block diagram of a weft picking system of a third embodiment of an air jet loom in accordance with the present invention.

FIG. 7 illustrates a third embodiment of the air jet loom according to the present invention, whose weft picking system is similar to that of the second embodiment with the exception that an auxiliary main nozzle or weft inserting nozzle 50 and an air supply line (no numeral) therefor are provided in place of the air supply line 40. More specifically, the auxiliary main nozzle 6 is disposed on the yarn introduction side of the main nozzle 6, in which weft yarn 10 is passed through the main nozzle 6 after being passed through the auxiliary main nozzle 50. The auxiliary main nozzle 50 is supplied with pressurized air from the pressurized air supply source 1 via the air supply line including a pressure regulator 51, an air tank 52, and an electromagnetic valve 53. The pressure regulator 51 fluidly connected to the pressurized air supply source 1 is further fluidly connected to the air tank 52 which is in turn fluidly connected to the electromagnetic valve 53. The electromagnetic valve 53 is in fluid communication with an air ejection opening (not shown) of the auxiliary main nozzle 50. The auxiliary main nozzle 50 may be installed to a frame (not shown) of the loom or to a sleigh (13 in FIG. 1) in the same manner as the main nozzle 6.

A control system of the loom of this embodiment is the same as that in FIG. 6 with the exception that the coil 45 is of the electromagnetic valve 53, in which the closing time period of the timer contact 43 is set at such a value as to obtain an air ejection time period with which a lowered traction force of the main nozzle 6 is sufficiently compensated.

The operation of the weft picking system of FIG. 7 will be discussed with reference to the control device of FIG. 6. When the preparation switch 23 is closed, the electromagnetic valve 4 is opened. Subsequently, when the starting switch 30 is closed, the electromagnetic valve 53 is opened, and simultaneously the timer contact 43 initiates its clocking operation while starting the operation of the loom driving motor 36. Upon opening of the electromagnetic valve 53, pressurized air is ejected from the auxiliary main nozzle 50 to pull the weft yarn 10; however, the weft picking time period has not yet come and consequently the weft yarn 10 is not picked. When the weft picking time period has come, the mechanical valve 5 is opened to eject pressurized air from the main nozzle 6, so that the weft yarn 10 is released in order to be picked. Then, the traction forces due to the main nozzle 6 and the auxiliary main nozzle 50 are applied to the weft yarn 10, and therefore the weft yarn 10 receives a greater traction force. At this stage, the timer contact 43 is opened at a point of time at which the traction force shortage of the main nozzle has been compensated by the traction force due to the auxiliary main nozzle 50, thereby causing the electromagnetic valve 53 to be closed. As a result, the air ejection from the auxiliary main nozzle 50 is stopped.

Figure 9:
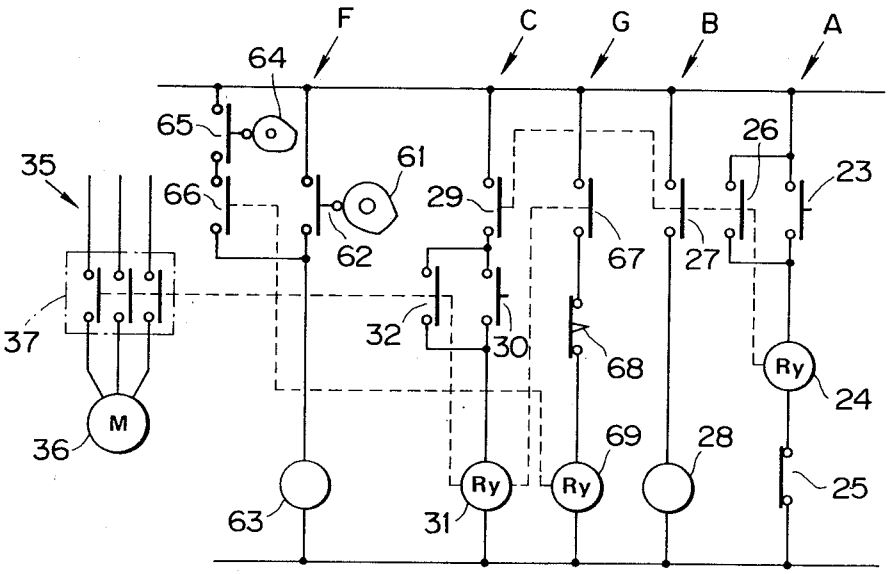
FIG. 9 is a circuit diagram of a control system for the loom of FIG. 8.
Figure 8:
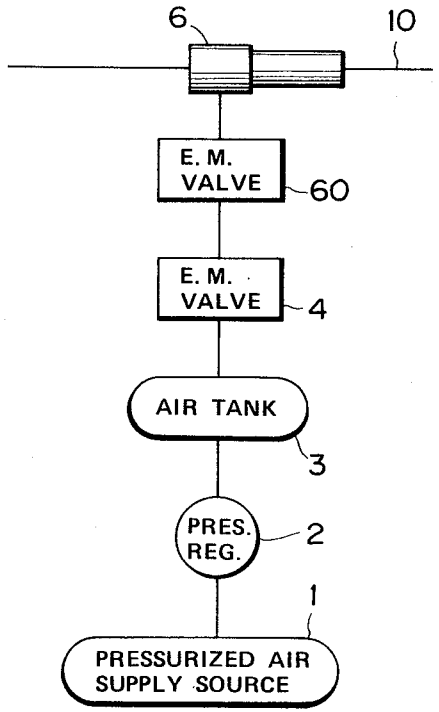
FIG. 8 is a block diagram of a weft picking system of a fourth embodiment of an air jet loom in accordance with the present invention.

FIGS. 8 and 9 illustrate a fourth embodiment of the air jet loom according to the present invention, whose weft picking system is similar to the second embodiment of FIG. 5 with the exception that an electromagnetic valve 60 is used in place of the mechanical valve 5, omitting the air supply line 40. The electromagnetic valve 60 is fluidly connected at its inlet to the electromagnetic valve 4 and at its outlet to the air ejection opening of the main nozzle 6.

A control system of the loom of this embodiment is similar to that of FIG. 6 except that a control circuit F for the electromagnetic valve 60 and a circuit G operated at starting of the loom are added while omitting the control circuit E for electromagnetic valve 42. The control circuit F for the electromagnetic valve includes a contact 62 which is closed in the weft picking time period by means of a cam 61. A coil 63 of the electromagnetic valve 60 is connected in series with the contact 62. Additionally, a circuit (no numeral) including a contact 65 and a normally opened contact 66 which are connected in series with each other is connected in parallel with the contact 62. The contact 65 is adapted to be closed earlier than the timing of closing of the contact 62, by means of a cam 64. The contact 66 is part of a relay 69 which will be discussed hereinafter. The circuit G includes a normally opened contact 67 of the relay 31. A timer contact 68 is connected in series with the contact 67 and adapted to be opened upon the lapse of a predetermined time after electric current is supplied thereto. Additionally, the relay 69 is connected in series with the timer contact 68. The contact 66 is adapted to be closed upon operation of the relay 69.

In operation of the weft picking system of FIG. 8, when the preparation switch 23 is first closed, the relay 24 is operated thereby causing the contacts 26, 27, 29 to be closed. Upon closing of the contact 26, the preparation circuit A enters its self-hold mode. Upon closing of the contact 27, the coil of the control circuit B is energized thereby causing the electromagnetic valve 4 to be opened, so that the pressurized air reaches the inlet of the electromagnetic valve 60. Subsequently, when the starting switch 30 is closed, the relay 31 is operated thereby causing the contacts 32, 67 and the contactor 37 to be closed. The starting circuit C enters its self-hold mode upon closing of the contact 32. Upon closing of the contact 67, the timer contact 68 in the circuit G initiates its clocking operation accompanied by operation of the relay 69 to cause the contact 66 to be closed. Although the contact 66 is closed, the coil 63 in the control circuit F remains de-energized because the contact 65 is being opened. Additionally, upon closing of the contact 37, the loom driving motor 36 starts to drive the loom. Accordingly, the cams 61, 64 rotate in timed relation to a main shaft (not shown) of the loom through which shaft the driving force from the motor 36 is transmitted to a variety of rotatable parts of the loom. First the contact 62 is closed by the cam 64 to energize the coil 63 in the control circuit F, so that the electromagnetic valve 60 is opened. Consequently, the pressurized air is ejected from the main nozzle 6. Immediately thereafter, the contact 62 is closed by the cam 61. Thereafter, the timer contact 68 makes its clocking operation of the predetermined time and is closed after the predetermined time, so that the relay 69 is made inoperative thereby causing the contact 66 to be opened. However, at this time, the contact 62 has already been closed and accordingly the electromagnetic valve 60 remains opened. When the weft picking is completed, the contact 62 is opened by the cam 61, so that the coil 63 is de-energized thereby causing the electromagnetic valve 60 to be closed. At the time of the second rotation or thereafter, the contact 66 continues to be opened, and therefore the cam 64 does not effect the loom operation, in which the open and close operation of the electromagnetic valve 60 is made only upon the open and close operation of the contact 62. Thus, for the first weft picking at a re-start of the loom, the pressurized air is supplied to the main nozzle earlier (in terms of angular position of the loom main shaft) than that during normal loom operation, so that the traction force begins to be applied to the weft yarn earlier by an amount as mentioned above, thus preventing the shortage of the weft yarn traction force.

FIGS. 10 to 17 illustrate a fifth embodiment of the air jet loom according to the present invention, in which the principle of the present invention is applied to an air jet loom arrangement of the type wherein the pressure of air to be supplied to the main nozzle is regulated depending on the nature of the weft yarn to be used. The air jet loom arrangement is, for example, disclosed in Japanese Patent Application No. 59-151982.

Figure 10:
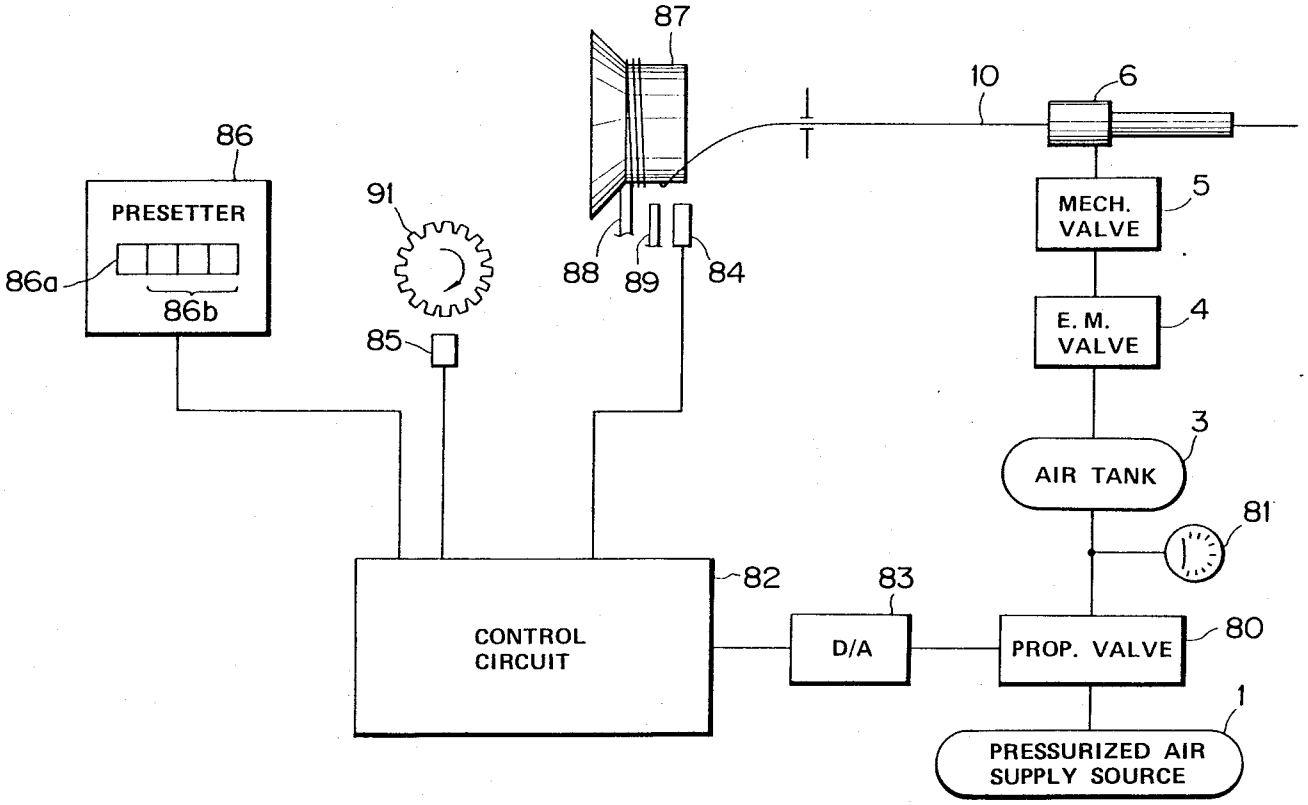
FIG. 10 is a block diagram of a fifth embodiment of an air jet loom in accordance with the present invention, showing a weft picking system in combination with a control system for the loom.

The loom of this embodiment is provided with a weft picking system 70 and a control system 72 for controlling the air pressure to be supplied to the main nozzle 6 as shown in FIG. 10. Referring to FIG. 10, the main nozzle 6 is supplied with pressurized air from the pressurized air supply source 1 through an electric signal-air pressure proportion valve 80, the air tank 3, the electromagnetic valve 4, and the mechanical valve 5. The electric signal-air pressure proportion valve 80 is adapted to regulate the pressure of air from the pressurized air supply source 1 to a level in proportion to an electric signal input thereto. The air tank 3 is adapted to detain an amount of air required for about one weft picking. The electromagnetic valve 4 is so adapted to open upon the closing of the preparation switch 23 of the loom while closing upon receiving a signal representative of a stopping of the loom. The mechanical valve 4 is so adapted to open during the weft picking time period. It will be understood that the valves 80, 4, 5 are so arranged that pressurized air from the pressurized air supply source 1 can flow therethrough when they are open. Additionally, a pressure gauge 81 is disposed between the valve 80 and the air tank 3.

A control circuit 82 forming part of the control system 72 is adapted to output digital signals which are to be converted to analog signals by a D/A converter 83, the analog signals being input to the electric signal-air pressure proportion valve 80. Input to the control circuit 82 are signals from a weft wind-off detector 84, from an angle sensor 85, and from a presetter 86. Additionally, a signal from a proximity switch (not shown) is also input to the control circuit 82, which switch is adapted to produce a signal per one rotation of the loom main shaft. The wind-off detector 84 is adapted to detect the passage of the weft yarn 10 wound off from a drum 87 of a weft storage device at the time of weft picking.

Figure 11:
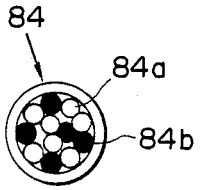
FIG. 11 is an enlarged plan view of the tip end of a weft wind-off detector forming part of the control system of FIG. 10.
Figure 12:
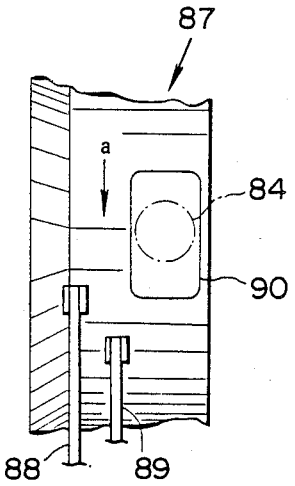
FIG. 12 is a fragmentary front view of a weft storage device drum in connection with the wind-off detector of FIG. 11.
Figure 13:
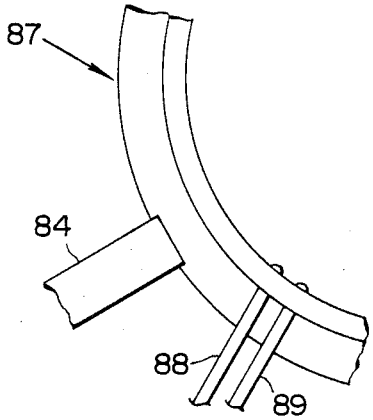
FIG. 13 is fragmentary side view of the drum of FIG. 12 in connection with the weft wind-off detector of FIG. 10.

As shown in FIGS. 11 to 13, the wind-off detector 84 includes a bundle of optical fibers some of which have a light casting face 84*a* from which light is casted and the other having a light receiving face 84*b* through which light enters the optical fiber as shown in FIG. 11. As shown in FIGS. 12 and 13, the wind-off detector 84 is so disposed that the light casting and receiving faces 84*a*, 84*b* spacedly face to a rectangular section 90 on the surface of the weft storage drum 87, the rectangular section 90 being located on the side of the main nozzle 6 relative to a hole $H_2$ and immediately on the upstream side of a hole $H_1$ and the hole $H_2$ in a direction (indicated by the arrow a) in which the weft yarn 10 is wound off. It will be understood that the engaging pins 88, 89 are insertable into and withdrawable from the holes $H_1$, $H_2$ respectively. The rectangular section 90 is finished to obtain a mirror face.

Thus, light casted from the light casting face 84*a* of the optical fiber is reflected on the mirror face of the rectangular section 90 and enters through the light receiving face 84*b* back to the optical fiber. However, when the weft yarn 10 passes through between the mirror face of the rectangular section 90 and the light casting and receiving faces 84*a*, 84*b* upon the weft yarn 10 being wound off from the drum 87, light is interrupted to reduce the amount of light entering the optical fiber, thereby detecting the passage of the weft yarn 10. Here, assuming that the weft yarn 10 is being wound four times on the drum 87 as an amount corresponding to one weft picking, a detection signal is obtained per one time wind-off of the weft yarn 10 on the drum 87, so that four detection signals (first, second, third and fourth signals) are obtained by the time the weft picking terminates. It is to be noted that one signal selected from the four detection signals is used as a wind-off signal for control. The angle sensor 85 is located facing to a rotatable member 91 which rotates in timed relation to the loom main shaft and provided at its periphery with three hundred and sixty projections. The angle sensor 85 is adapted to sense the passage of each projection of the rotatable member 91 to detect the rotation angle of the loom main shaft (referred hereinafter to "main shaft angle"), in which count-up of 1° is made upon the sensing of each projection of the rotatable member 91 and in which the output corresponding to 0° is made subsequent to the output corresponding to 359°. The presetter 60 is adapted to preset the information required for the control circuit 82, and includes a binary switch 86*a* by which hexadecimal input is made, and three decimal switches 86*b* by which decimal input is made. Accordingly, the control circuit 82 performs predetermined operations in accordance with the control inputs from the weft wind-off detector 84, the angle sensor 85, and the presetter 86. The output of control circuit 82 is fed to the D/A converter 83 to carry out controlling the air pressure to be supplied to the main nozzle 6.

Figure 14:
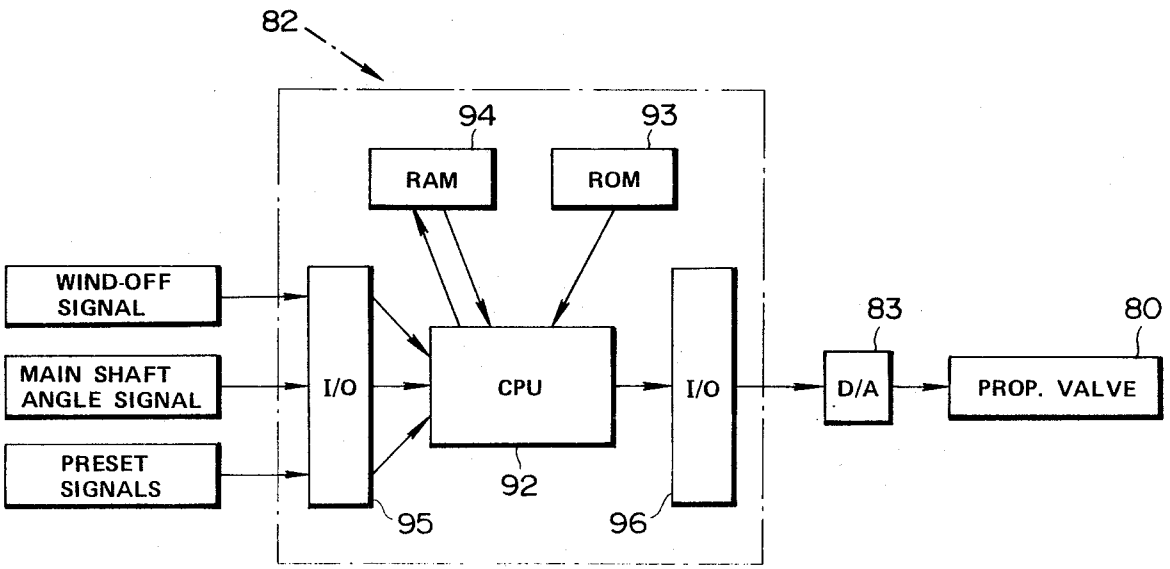
FIG. 14 is a block diagram of a hardware arrangement of a control circuit forming part of the control system of FIG. 10.

As shown in FIG. 14, the control circuit 51 includes a CPU 92, a ROM 93, a RAM 94, and I/O (input and output) devices 95, 96. Accordingly, read through the I/O device 95 in the CPU 92 are the wind-off signal from the weft wind-off detector 84, a signal (representative of the main shaft angle T) from the angle sensor 85, and a signal (representative of a standard angle set value To), a signal (representative of an allowable limit set value LM), a signal (representative of an initial pressure set value V of air to be supplied to the main nozzle 16), a signal (representative of a pressure upper limit set value Va), a signal (representative of a pressure lower limit value Vb), and a signal (representative of a pressure increase value or coefficient K at loom starting) from the presetter 86. Necessary data are written in the RAM 94 and read out from the RAM 94 in accordance with the program of the ROM 93, and are output to the D/A converter 83 through the I/O device 96.

Figure 15A:
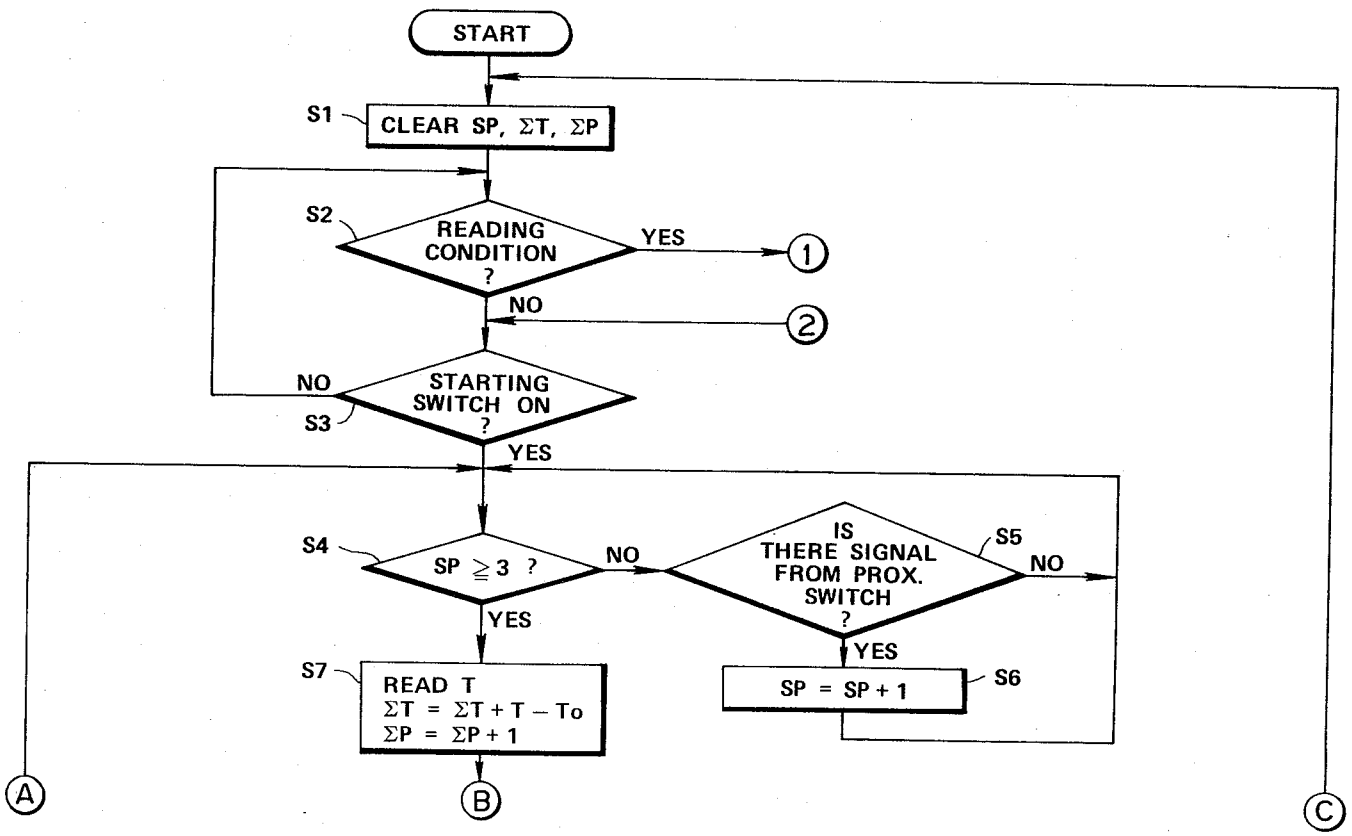
FIGS. 15 to 17 are flow charts showing a procedure of control of the control system of FIG. 10.
Figure 15B:
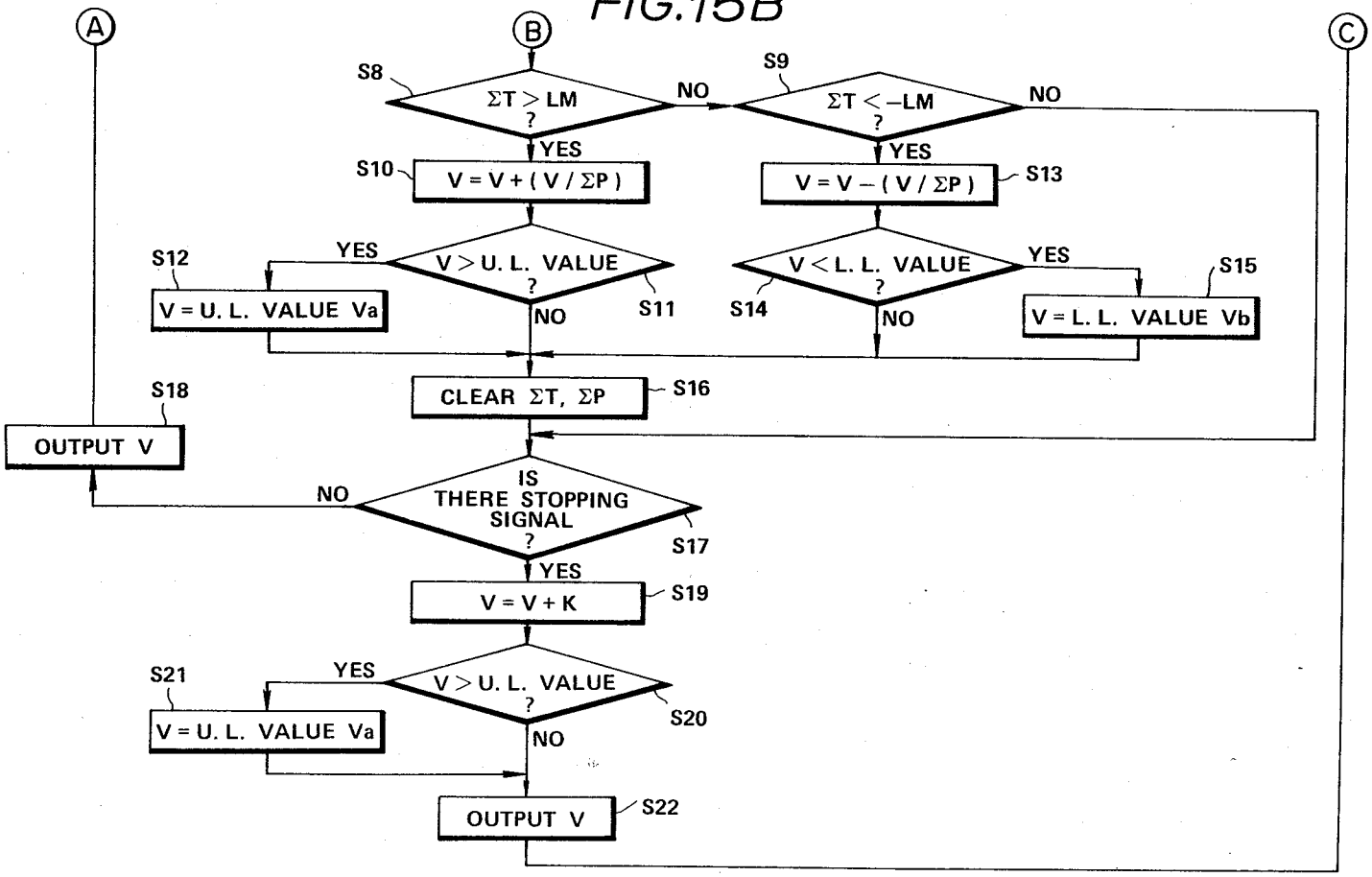
Figure 16:
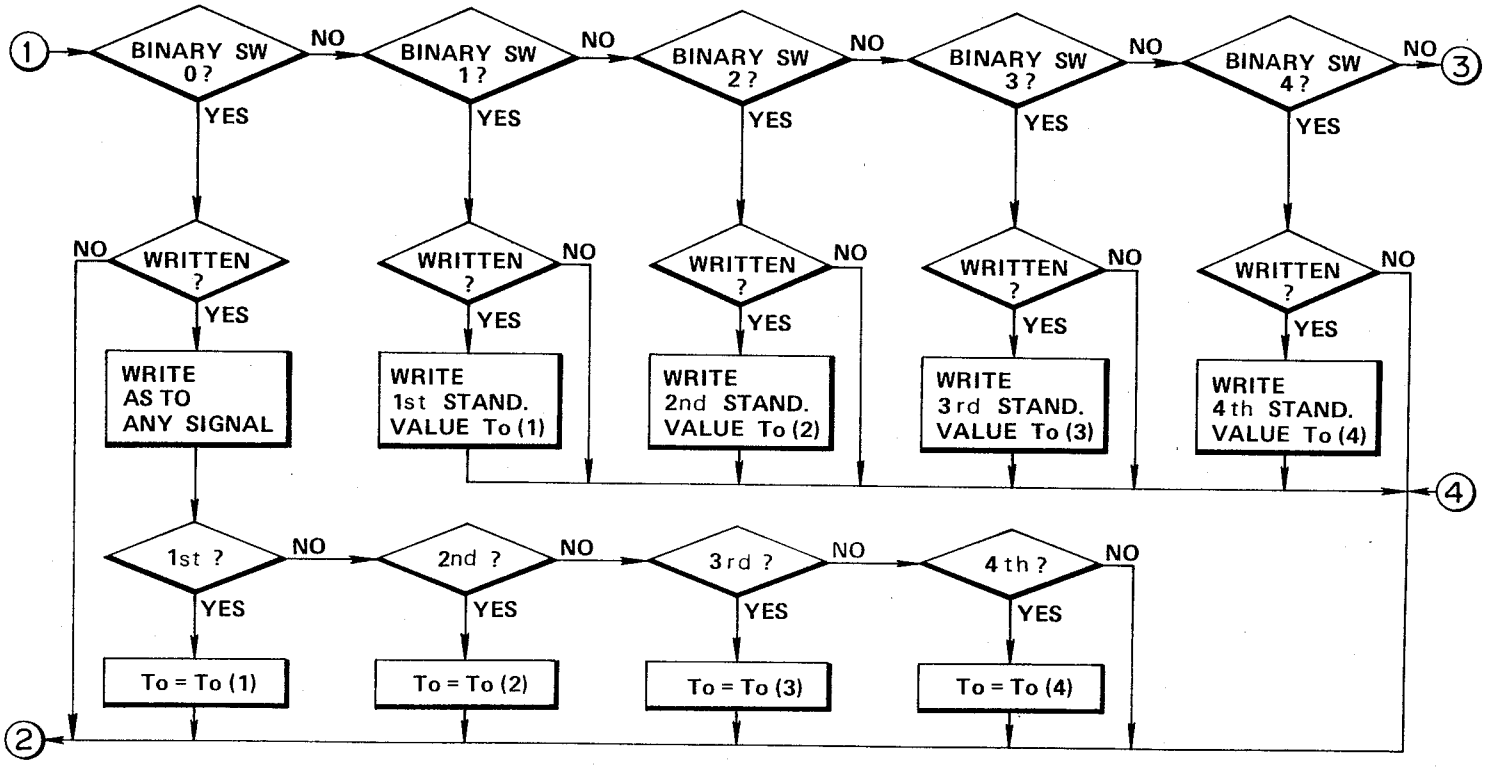
Figure 17:
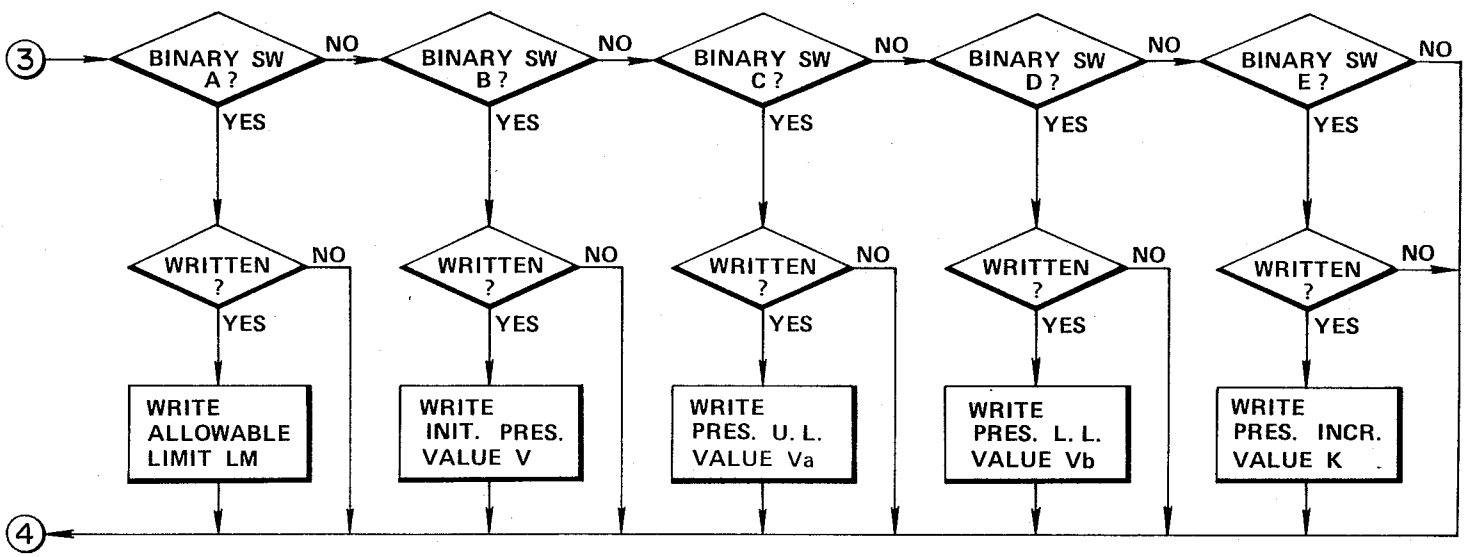

The manner of operation of the loom provided with the control system 72 will be discussed hereinafter with reference to FIGS. 15 to 17.

First, when the loom is electrically connected to an electric source, the pick number SP from the starting of loom operation and accumulated values ΣT, ΣP discussed after are cleared. (See a step S1 of a flow chart in FIG. 15).

Subsequently, a discrimination is made as to whether a reading condition (in which reading is made) of the informations from the presetter 86 has been reached (a reading switch for accomplishing reading operation: ON) or not (See a step S2). Where various conditions are newly set or changed in the reading condition, such conditions are input through the presetter 86 in accordance with the flow in FIGS. 16 and 17. More specifically, where the binary switch 86*a* of the presetter 86 is "0" in which a setting is made to be as to selecting any of four times winding-off frequency of the weft yarn 10, a discrimination is made to whether a new value is to be written (the writing switch: ON) or not. When a new value is written, the new value set by the three decimal switches 86*b* is written in the RAM 94 to be memorized. That is, in order to set the selection of one of four times winding-off frequency, the binary switch 86*a* is set at "0"; the decimal switches 86*b* are set at "004" in the case of selecting the fourth winding-off of the weft yarn 11; and the writing switch is switched ON. By this, the standard angle set value To is set at a previous value in accordance with the selection in winding-off frequency. In order to change this, the binary switch 86*a* is set at "4"; the decimal switches 86*b* are set, for example, at "230" representative of an angle; and the writing switch is switched ON.

In order to set the allowable limit LM, it is sufficient that the binary switch 86*b* is set at "A"; the decimal switches 86*b* are set, for example, at "100"; and the writing switch is switched ON. In order to set the initial pressure valve V, the binary switch 86*a* is set at "B"; the pressure value V is set by the decimal switches 86*b* and the writing switch is switched ON. Additionally, in order to set a pressure upper limit value Va, it is sufficient that the binary switch 86*a* is set at "C"; the value Va is set by the decimal switches 86*b;* and the writing switch is switched ON. In order to set the pressure lower limit value Vb, it is sufficient that the binary switch 86*a* is set at "D" and thereafter the same procedures as above are carried out. Additionally, in order to set the pressure increase value K, it is sufficient that the binary switch 86*a* is set at "E"; the decimal switches 86*b* are set at "020" for example in case of $K=0.2$ ($Kg/cm^2$); and the writing switch is switched ON.

Subsequently, when the starting switch of the loom is switched ON, the pick number SP from the loom operation starting is judged (See steps S3 and S4). Until the pick number SP has reached two, a discrimination is made as to whether there is a signal from the proximity switch or not (See a step S5). In the case where there is the signal, the pick number SP is counted up (See a step S6), standing ready to become three. Thus, until the pick number SP has reached two, the pressure control and reading the informations therefor are not carried out, but are merely standing ready for stable revolution of the loom upon reaching a predetermined revolution speed. At this time, ejection of air from the main nozzle 6 is carried out under the initial pressure V of air controlled by the electric signal-air pressure proportion valve 80.

After the pick number SP has reached three, the signal representative of the actual main shaft angle T from the angle sensor 85 is read at a point in time at which a predetermined detection signal (for example, the fourth detection signal) of the four detection signals from the weft wind-off detector 84 is input when the weft yarn 10 is wound off from the drum 87 during weft picking. Then, a subtraction of the standard value To from the actual main shaft angle T is made to obtain a difference ($T=To$), and an accumulated value $\Sigma T$ of such differences ($T-To$) is calculated. Simultaneously, the value of the $\Sigma P$ indicating the number of picks from the starting of such an accumulation is upped by one (See a step S7).

Next, a discrimination is made as to whether the accumulated value $\Sigma T$ of the differences ($T-To$) exceeds the allowable limit LM (for example, $\pm 100$) on the plus or minus sides or not (See Steps S8 and S9). In case of exceeding the plus side allowable limit, the present pressure value (or the previously set initial pressure value) V is divided by the pick number $\Sigma P$ (for example, 10) before exceeding the allowable limit. The thus obtained divided value is added to the present pressure value V thereby to set a new pressure value V (See a step S10). Subsequently, the thus set pressure value V is compared with the upper limit value Va (See a step 11), and set as an upper limit value Va when valve V is larger than the upper limit value Va (See a step S12). When the minus side exceeds allowable limit, the present pressure value V is divided by the pick number $\Sigma P$ before exceeding the allowable limit. The thus obtained divided value is subtracted from present pressure value V thereby to set a new pressure V (See a step S13). Subsequently, the thus set pressure V is compared with the lower limit value Vb (See a step S14), and set as a lower limit value Vb when valve V is smaller than the upper limit value Va (See a step S15).

When the pressure V has been thus newly set, a discrimination is made as to whether there is a stopping signal representative of stopping loom operation or not (See a step 17) after the accumulated values $\Sigma T$, $\Sigma P$ are cleared. Where there is no stopping signal, a signal representative of this pressure V is output to the D/A converter 83 (See a step 18).

Thus, where the accumulated value $\Sigma T$ of the difference between the detected value T and the standard value To of wind-off timing exceeds the plus side allowable limit LM, the weft picking time is too long and therefore the pressure V to be supplied to the main nozzle 6 is raised by an amount corresponding to the pick number required before exceeding the allowable limit, thereby enlarging the traction force to the weft yarn to obtain an appropriate weft picking time. In contrast where the accumulated value exceeds the minus side allowable limit $-LM$, the weft picking time is too short and therefore the pressure V to be supplied to the main nozzle 6 is lowered by an amount corresponding to the pick number required before exceeding the allowable limit, thereby minimizing the traction force to the weft yarn to obtain the appropriate weft picking time. It will be understood that supply of the previous pressure V to the main nozzle is continued in case where the accumulated value of the differences between the detected value and the standard value of the wind-off timing does not exceed the allowable limits.

Where there is the stopping signal in the discrimination at the step 17, the pressure increase value K (for example, 0.2 $Kg/cm^2$) is added to the present pressure V to set a new pressure V (See a step 19). It is to be noted that if this new pressure V exceeds the upper limit value Va, it is set as the upper limit value Va (See steps 20, 21). Then, a signal representing the thus increased pressure is output to the D/A converter 83 (See a step 22).

Upon thus raising the pressure to be supplied to the main nozzle 6 at the time of a stopping of the loom, the pressure to be supplied to the main nozzle 6 is raised at re-start of the loom. When the loom is re-started, a signal from the angle sensor 85 becomes representative of the main shaft angle T smaller than the standard value To because of the raised pressure, so that the pressure is gradually restored to an appropriate value.

It will be understood that the pressure increase value K may be used as a coefficient, in which the pressure V is multiplied by the value K. The weft picking system with the control system 72 may be so arranged that the first re-start of the loom is accomplished under the same pressure as at the time when the loom stopping has been made, while re-start of the loom is accomplished under such a high pressure employed in this embodiment in the event that a loom stopping again arises due to mis-pick within predetermined picks from the first re-start.

While detection has been shown and described as being made for the timing at which a predetermined condition has been reached within a weft picking or at the termination of a weft picking, it will be understood that a tension of the weft yarn may be measured as the force required for weft picking in which the tension of the weft yarn is measured at the time of weft picking termination at which the weft yarn 10 is brought into engagement with the engaging pin 89 in connection with the weft storage drum 87, for example by using a strain gauge (not shown) attached to the engaging pin 89, the strain gauge being adapted to detect the deflection of the engaging pin.

What is claimed is:

1. An air jet loom comprising:

a weft inserting nozzle through which a weft yarn is picked under a traction force of an air jet ejected from said nozzle;

means for accomplishing a weft picking under said traction force at a first level during normal loom operation except at least when the loom is started; and means for increasing said traction force to a second level not lower than said first level for a predetermined time at starting of the loom.

2. An air jet loom as claimed in claim 1, wherein said weft picking accomplishing means includes means for supplying an air pressure at a first level to said weft inserting nozzle during the normal loom operation, in which said traction force increasing means includes means for increasing said air pressure to a second level higher than said first level for said predetermined time at the start of the loom, wherein said first level is one of a plurality of levels in air pressure in the normal operation, said second level is not lower than a third level at time immediately before stopping of operation of the loom, wherein said third level is one of said plurality of levels.

3. An air jet loom as claimed in claim 1,further comprising means for producing a first signal representative of the starting of the loom, in which said traction force increasing means includes means for increasing to said second level said traction force for at least a first weft picking at the loom starting of the loom for said predetermined time.

4. An air jet loom as claimed in claim 3, further including means for timing said first signal.

5. An air jet loom as claimed in claim 3, wherein said weft picking accomplishing means includes means for supplying an air pressure at a first level to said weft inserting nozzle during the normal loom operation, in which said traction force increasing means includes means for increasing at least said air pressure for the first weft picking when the loom is started to a second level higher than said first level for said predetermined time in response to said first signal.

6. An air jet loom as claimed in claim 5, wherein said air pressure supply means includes a first valve fluidly connected to said weft inserting nozzle and arranged to be opened to establish fluid communication therethrough at the time of the weft picking, and a first pressure regulator fluidly connectable with said first valve and fluidly connected to a pressurized air supply source, said first pressure regulator being arranged to regulate an air pressure from said pressurized air supply source to a first level, in which said air pressure increasing means includes a second pressure regulator fluidly connectable with said first valve and arranged to regulate the air pressure from said pressurized air supply source to a second level higher than said first level.

7. An air jet loom as claimed in claim 6, wherein said air pressure increasing means includes a second valve fluidly interposed between said first valve and said second pressure regulator, and arranged to be closed to block fluid communication between said first valve and said second pressure regulator prior to production of said signal.

8. An air jet loom as claimed in claim 7, wherein said air pressure supply means includes a first check valve fluidly interposed between said first valve and said first pressure regulator to prevent air to flow in direction of said air regulator valve, in which said air pressure increasing means includes a second check valve fluidly interposed between said first valve and said second valve to prevent air to flow in the direction of said second valve.

9. An air jet loom as claimed in claim 8, further comprising means for producing a second signal representative of preparation of operation of the loom prior to production of said first signal.

10. An air jet loom as claimed in claim 9, wherein said second valve is arranged to be opened to establish fluid communication therethrough in response to said second signal.

11. An air jet loom as claimed in claim 3, wherein said weft picking accomplishing means includes means for supplying air pressure to said weft inserting nozzle at the time of the weft picking, in which said traction force increasing means includes means for earlier supplying said air pressure to said weft inserting nozzle prior to the time of weft picking.

12. An air jet loom as claimed in claim 11, wherein said air pressure supply means includes a first valve fluidly connectable with a pressurized air source and arranged to be opened to establish fluid communication between said weft inserting nozzle and said pressurized air supply source, in which said air pressure earlier supply means is arranged to supply said air pressure to a first air supply passage fluidly connecting said weft inserting nozzle and said first valve in response to said first signal.

13. An air jet loom as claimed in claim 12, wherein said air pressure earlier supply means includes a second valve arranged to be opened to establish fluid communication between said first air supply passage and a second air supply passage between said first valve and said pressurized air supply source in response to said first signal and to be closed to block the fluid communication prior to opening of said first valve.

14. An air jet loom as claimed in claim 13, wherein said air pressure earlier supply means includes timer means for allowing said second valve to be opened during said predetermined time.

15. An air jet loom as claimed in claim 14, wherein said air pressure earlier supply means includes a flow restrictor fluidly interposed between said second valve and the second air supply passage to restrict the flow of air therethrough.

16. An air jet loom as claimed in claim 3, wherein said traction force increasing means includes an auxiliary weft inserting nozzle through which said weft yarn is passed in addition to said weft picking nozzle, said auxiliary weft inserting nozzle being supplied with an air pressure for at least a part of the time of the weft picking.

17. An air jet loom as claimed in claim 16, wherein said weft picking accomplishing means includes a first valve fluidly connected to said weft inserting nozzle and fluidly connectable with a pressurized air supply source, said first valve being arranged to be closed to establish fluid communication between said weft inserting nozzle and said pressurized air supply source, in which said traction force increasing means includes a second valve arranged to be opened to establish fluid communication between said auxiliary weft inserting nozzle and said pressurized air supply source.

18. An air jet loom as claimed in claim 17, wherein said traction force increasing means includes timer means for allowing said second valve to be opened for said predetermined time, in which said second valve is opened in response to said first signal and prior to time of opening of said first valve.

19. An air jet loom as claimed in claim 11, wherein said air pressure supply means includes a pressurized air supply source fluidly connected to said weft inserting nozzle, in which said air pressure earlier supply means includes a valve fluidly interposed between said pressurized air supply source and said weft inserting nozzle, said valve being arranged to be opened to establish fluid communication between said pressurized air supply source and said weft inserting nozzle, and means for causing said valve to be opened earlier in said first weft picking than in a weft picking during normal loom operation.

20. An air jet loom as claimed in claim 19, wherein valve is an electromagnetic valve having a coil arranged to be opened when said coil is energized upon being supplied with electric current, in which said air pressure supply means includes a first switch electrically connected to said electromagnetic valve coil and arranged to be closed to supply electric current to said electromagnetic valve coil at the time of the weft picking, in which said air pressure earlier supply means includes a second switch electrically connectable with said electromagnetic valve coil and arranged to be closed to supply electric crrrent to said electromagnetic valve coil, means for causing said second switch to be closed earlier than said first switch, and a third switch electrically interposed between said second switch and said electromagnetic valve coil to be closed to establish electric connection between said second switch and said electromagnetic valve coil in response to said first signal.

21. An air jet loom as claimed in claim 20, wherein said second switch causin9 means includes first and second cams rotatable in timed relation to an operational cycle of the loom, said first cam being operatively connected to said first switch and arranged to initiate closing of said first switch at a first timing, said second cam being operatively connected to said second switch and arranged to initiate closing of said second switch at a second timing earlier than said first timing.

22. An air jet loom as claimed in claim 1, wherein said weft picking accomplishing means includes means for supplying an air pressure at a first level to said weft inserting nozzle during the normal loom operation, in which said traction force increasing means includes means for increasing said air pressure to a second level higher than said first level for said predetermined time at the starting of the loom.

23. An air jet loom as claimed in claim 22, wherein said air pressure supply means includes a first valve fluidly connected to said weft inserting nozzle and fluidly connectable with a pressurized air supply source, said first valve being arranged to be opened to establish fluid communication between said weft inserting nozzle and said pressurized air supply source for the time of the weft picking.

24. An air jet loom as claimed in claim 23, wherein said air pressure increasing means includes control means for generating a signal representative of the starting of the loom, and a second valve fluidly interposed between said first valve and said pressurized air supply source and arranged to control the air pressure to said second level in response to said signal from said control means.

25. An air jet loom as claimed in claim 24, wherein said control means includes means for setting said first pressure level and said second pressure level, means for producing a first signal representative of said first pressure level during the normal loom operation and a second signal representative of said second pressure level at the starting of the loom, in which said second valve is arranged to control the air pressure to said first level in response to said first signal and to said second level in response to said second signal.

26. An air jet loom as claimed in claim 25, wherein said control means includes means for producing a third signal representative of stopping of operation of the loom in which said setting means is arranged to set said second pressure level in response to production of said third signal..

27. An air jet loom as claimed in claim 1, further including means for accomplishing a weft picking under said traction force at one of a plurality of levels of traction force in the normal loom operation.

* * * * *